US007665621B2

(12) United States Patent
Doh et al.

(10) Patent No.: US 7,665,621 B2
(45) Date of Patent: Feb. 23, 2010

(54) SELF MOVABLE CRANE SYSTEM WITH A BOOM

(75) Inventors: Nak Ju Doh, Seoul (KR); Gwi Tae Park, Seoul (KR); Kyung In Kang, Seoul (KR); Ung Kyun Lee, Seoul (KR); Tae Hoon Kim, Seoul (KR); Sung Hoon An, Seoul (KR); Tae Koo Kang, Seoul (KR); Jeong Eom Lee, Seoul (KR); Seoung Kyou Lee, Incheon (KR)

(73) Assignee: Korea University Industrial & Academic Collaboration Foundation, Seoul (KR)

( * ) Notice: Subject to any disclaimer, the term of this patent is extended or adjusted under 35 U.S.C. 154(b) by 65 days.

(21) Appl. No.: 12/033,774

(22) Filed: Feb. 19, 2008

(65) Prior Publication Data

US 2009/0039043 A1 Feb. 12, 2009

(30) Foreign Application Priority Data

Aug. 11, 2007 (KR) ..... 10-2007-0080976

(51) Int. Cl.
*B66C 23/18* (2006.01)

(52) U.S. Cl. ..... 212/314; 212/179; 212/224

(58) Field of Classification Search ..... 212/179, 212/314, 224

See application file for complete search history.

(56) References Cited

U.S. PATENT DOCUMENTS 3,761,551 A * 9/1973 Ogata et al. ..... 264/33
4,255,120 A * 3/1981 Straitz, III ..... 431/202
5,645,395 A * 7/1997 Huang ..... 414/560
5,653,508 A * 8/1997 Carney ..... 299/15
5,971,136 A * 10/1999 Takeda ..... 198/535

FOREIGN PATENT DOCUMENTS

JP 8-245174 A * 9/1996
JP 8-311818 A * 11/1996

* cited by examiner

*Primary Examiner*—Thomas J. Brahan
(74) *Attorney, Agent, or Firm*—Rabin & Berdo, PC

(57) ABSTRACT

A self movable boom system is provided. The self movable boom system include: a boom disposed on a plane perpendicular to a building clamp structure; and a moving unit apparatus including a circumferential moving unit which is disposed between the boom and the building clamp structure to move the boom on a plane perpendicular to the building clamp structure, a lifting-up unit of which one end is disposed toward the circumferential moving unit and of which other end is disposed toward the building clamp structure to move the boom along a longitudinal direction of the building clamp structure, and a boom moving unit which moves an object along the longitudinal direction of the building clamp structure and along a longitudinal direction of the boom.

8 Claims, 4 Drawing Sheets

SELF MOVABLE CRANE SYSTEM WITH A BOOM

CROSS-REFERENCE TO RELATED PATENT APPLICATION

This application claims the priority of Korean Patent Application No. 2007-0080976, filed on Aug. 11, 2006, in the Korean Intellectual Property Office, the disclosure of which is incorporated herein in its entirety by reference.

BACKGROUND OF THE INVENTION

1. Field of the Invention

The present invention relates to a self crane apparatus with a boom, and more particularly, to a self movable boom system having a self movable structure with respect to a building clamp structure.

2. Description of the Related Art

A steel-frame structure is one of building structures for construction of multistoried buildings. In general, steel-frame materials used for assembling a conventional steel-frame structure are moved up and down by using a rope attached to a tower crane installed at a height of, for example, 20 to 30 meters from a ground. In a typical tower crane, a mast, a telescoping cage, a cabin, and a cat head disposed on a base mask on a base anchor, and a main jib, a counter jib, and a trolley winding apparatus are disposed vertically to the mask. In order to ensure sufficient working area, the conventional tower crane needs to have a larger height than the building. Therefore, when the tower crane performs a circulation movement, a slight small angle error of at the end of the tower crane induces a large positional error with respect to an object, that is, a constructional material connected through a wire, so that associated tasks become vary difficult. Accordingly, only an highly-trained operator can drive the tower crane, so that personnel expenses are increased, and a shortage of trained operators occurs. In addition, due to the difficulty in tasks caused from the positional error, it is difficult to implement automation of construction processes such as moving the construction materials. In addition, the cabin lifting-up task through a telescoping cage at a very large height becomes difficult, and in case of a multistoried building, a support structure for the base mast needs to be very enlarged, so that a space of task cannot be easily ensured.

SUMMARY OF THE INVENTION

The prevent invention provides a self movable boom system capable of maintaining a suitable height of a boom used for moving an object such as construction materials and capable of performing self movement.

According to an aspect of the present invention, there is provided a self movable boom system comprising: a boom disposed on a plane perpendicular to a building clamp structure; and a moving unit apparatus including a circumferential moving unit which is disposed between the boom and the building clamp structure to move the boom on a plane perpendicular to the building clamp structure, a lifting-up unit of which one end is disposed toward the circumferential moving unit and of which other end is disposed toward the building clamp structure to move the boom along a longitudinal direction of the building clamp structure, and a boom moving unit which moves an object along the longitudinal direction of the building clamp structure and along a longitudinal direction of the boom.

In the above aspect, the boom moving unit may comprise: a hoist movably disposed to the boom to move the object; and a trolley disposed to the boom to move along the longitudinal direction of the boom; and a hoist driver disposed to the trolley to move the trolley in a direction perpendicular to the longitudinal direction of the boom. In addition, the circumferential moving unit may comprise: a circumferential moving roller unit including a circumferential moving roller supporter connected to the boom and a circumferential moving driving roller unit driving-ably disposed to the circumferential moving roller support member; a circumferential moving supporter disposed between the building clamp structure and the boom along an outer circumference of the building clamp structure; and a circumferential moving rail unit including a circumferential moving rail which disposed on an outer circumference of the circumferential moving supporter to contact with the circumferential moving roller unit and a circumferential moving rail support member of which one end is connected to the circumferential moving rail and of which other end is connected to the circumferential moving supporter.

In addition, a plurality of the circumferential moving roller units the circumferential moving rail units may be disposed to be separated from each other in a direction parallel to the vertical longitudinal direction of the building clamp structure. In addition, the self movable boom system may further comprise a boom supporting cable of which one end is disposed to the boom and of which other end is disposed to the circumferential moving unit. In this case, the other end of the boom supporting cable may be directly connected to any one of the circumferential moving roller support members of a plurality of the circumferential moving roller units.

In addition, the circumferential moving roller unit may comprise one or more circumferential moving guide roller units which are disposed to be separated from the circumferential moving driving roller unit and rotatably contact with the circumferential moving rail. In addition, the lifting-up unit may comprise: a lifting-up movement fixing unit including a lifting-up fixing support member fixed to a building holding unit and a lifting-up fixing shoe connected to the lifting-up fixing support member; and a lifting-up movement driver unit including a lifting-up movement rail detachably disposed to the lifting-up movement fixing unit and a lifting-up movement driver of which one end is detachably disposed to the lifting-up movement rail of which other end is fixed to the circumferential moving unit to perform extending and contracting movement.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, a self movable boom system according to the present invention will be described in detail with reference to the accompanying drawings.

Figure 1:
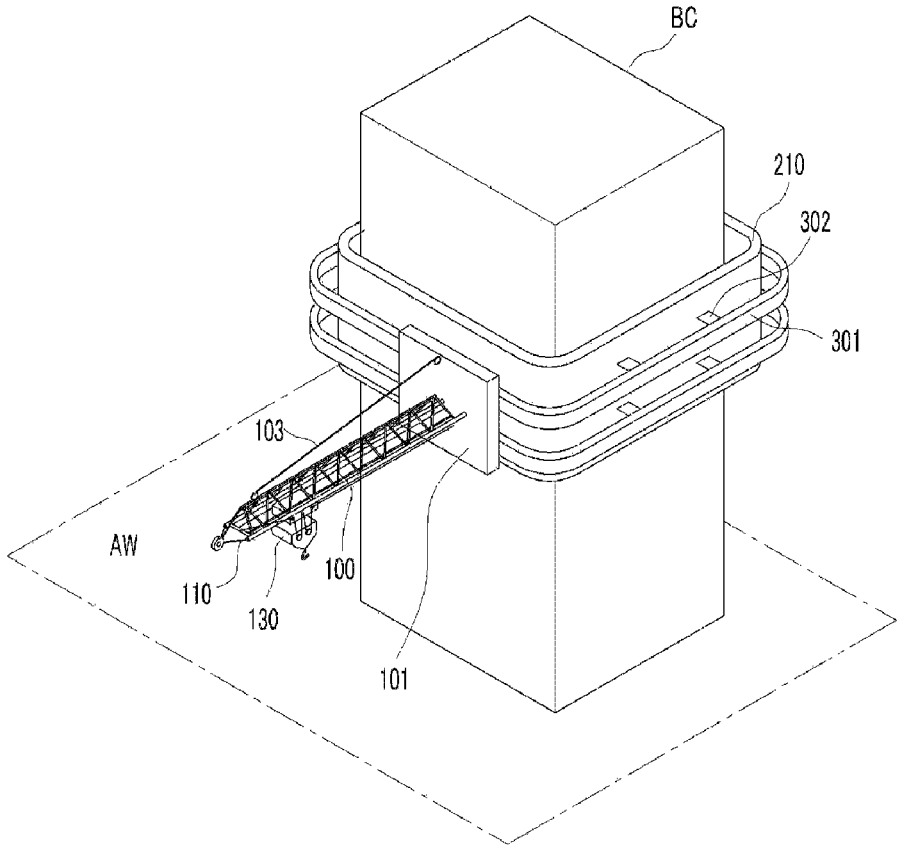
FIG. 1 is a schematic perspective view illustrating a self movable boom system according to an embodiment of the present invention.
Figure 2:
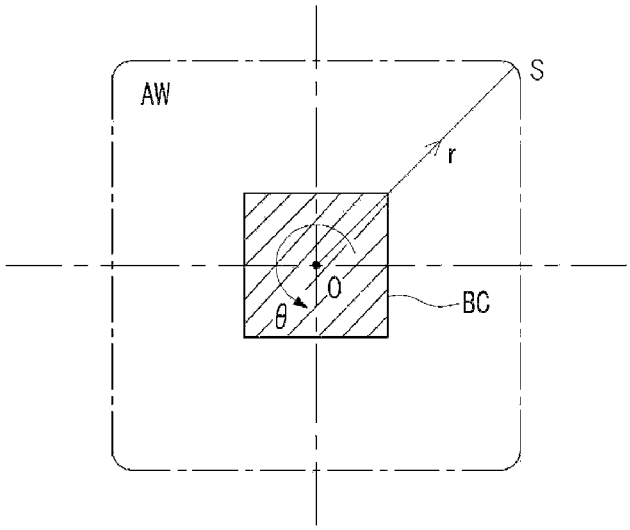
FIG. 2 is a schematic plan view illustrating a working area of a self movable boom system with respect to a building clamp structure on which the self movable boom system is mounted, according to an embodiment of the present invention.
Figure 3:
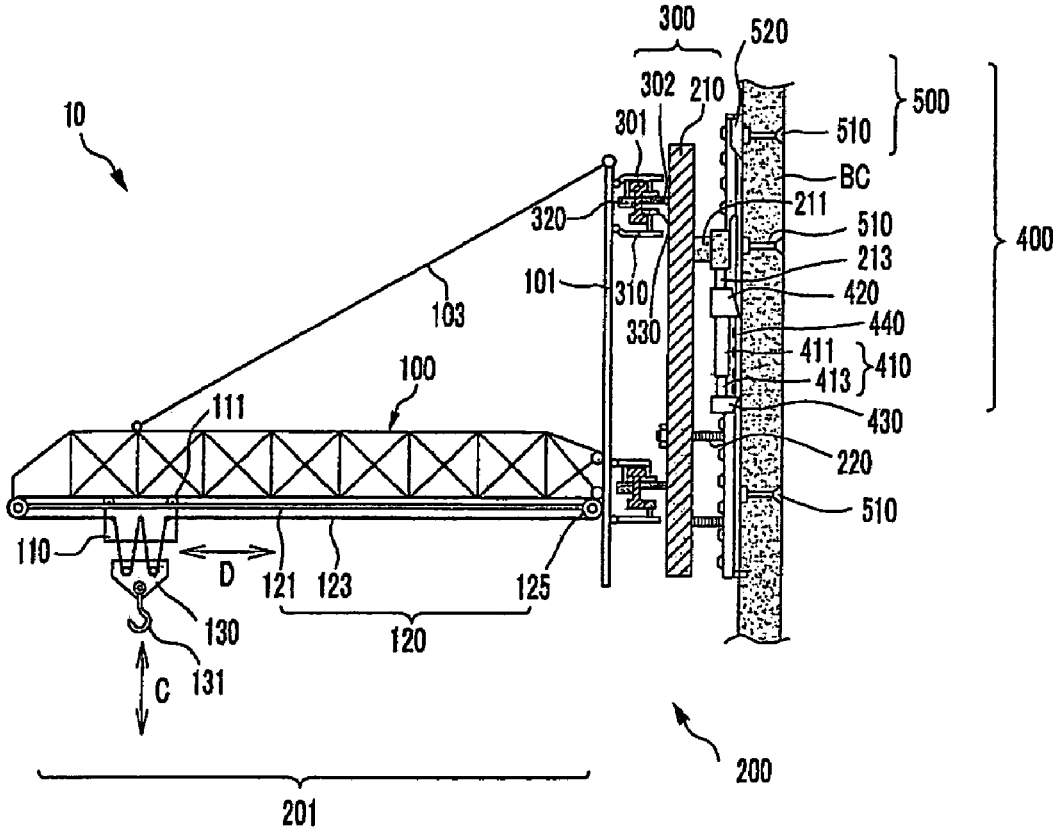
FIG. 3 is a schematic side view illustrating a self movable boom system according to an embodiment of the present invention.

FIG. 1 is a schematic perspective view illustrating a self movable boom system 10 according to an embodiment of the present invention. FIG. 2 is a schematic plan view illustrating a working area of the self movable boom system 10 with respect to a building clamp structure on which the self movable boom system 10 is mounted, according to an embodiment of the present invention. FIG. 3 is a schematic side view illustrating the self movable boom system 10 according to an embodiment of the present invention.

The self movable boom system 10 includes a boom 100 and a moving unit apparatus 200. The boom 100 is constructed as a one-armed-girder-type steel-frame structure for moving an object such as a construction material. The moving unit apparatus 200 is constructed as a means for moving the boom 100 with respect to a building clamp structure Bc. The self movable boom system 10 is movably disposed to the building clamp structure Bc. In the embodiment, the building clamp structure Bc is constructed with a core having a steel-reinforcing-rod concrete structure formed in advance by using an auto-climbing system or the like. Alternatively, the building clamp structure Bc may be constructed with other frame structures. The building clamp structure may be constructed in various structures capable of moving the self movable boom system 10 according to the present invention.

A circumferential moving supporter 210 of the moving unit apparatus 200 is disposed along the circumference of the building clamp structure Bc. A boom supporting plate 101 is movably disposed along a circumferential moving rail unit (301, 302) formed on the circumferential moving supporter 210. The boom 100 having a truss structure is provided to the boom supporting plate 101 in a direction perpendicular to a longitudinal direction of the building clamp structure Bc, that is, a direction parallel to a ground. A later-described hoist 130 is provided to the boom 100 to move an object such as a construction material. In FIG. 1, a working area associated with the boom 100 is denoted by reference numeral Aw. FIG. 2 is a schematic plan view illustrating the building clamp structure Bc and the working area Aw of FIG. 1. A hatching portion denoted by reference numeral Bc is the building clamp structure. A segment line OS from the center O for the circumference of the building clamp structure Bc denotes a radial direction (denoted by r) of a hoist 130 (see FIG. 1) moving along the longitudinal direction of the boom, and θ denotes a circumferential direction, that is, a counter-clockwise movement direction of the boom 100.

As shown in FIG. 3, the boom 100 is disposed on a plane perpendicular to the building clamp structure Bc. That is, the boom 100 disposed to the building clamp structure Bc formed perpendicular to the ground is disposed parallel to the ground. The boom 100 may have a truss structure which is used for a general tower crane. A later-described boom moving unit is provided to a lower portion of the boom 100. The one end of the boom 100 is formed as a free end, and the other end thereof is coupled to the boom supporting plate 101 through pin coupling. The boom supporting plate 101 according to the embodiment of the present invention is constructed as a plate type. Alternatively, the boom supporting plate may be constructed as a frame structure. The boom supporting plate may have various structures capable of supporting the boom 100. In addition, the self movable boom system 10, that is, a construction-materials moving system may further include a boom supporting cable 103. The one end of the boom supporting cable 103 is attached to the free end of the boom 100, and the other end of the boom supporting cable 103 is attached to a later-described circumferential moving unit, so that a structure for supporting the boom 10 can be further reinforced.

The moving unit apparatus 200 includes a boom moving unit 201, a circumferential moving unit 300, a lifting-up unit 400. The boom moving unit 201 is provided to a lower portion of the boom 100 to move the object such as construction materials in a longitudinal direction of the boom 100 and in a direction perpendicular to the boom 100. The circumferential moving unit 300 is disposed between the boom 100 and the building clamp structure Bc to allow the boom 100 to move on the plane perpendicular to the building clamp structure Bc. The one end of the lifting-up unit 400 is disposed toward the circumferential moving unit 300, and the other end thereof is disposed toward the building clamp structure Bc to allow the boom 100 to move in the longitudinal direction of the building clamp structure Bc, that is, in a direction perpendicular to the ground.

The boom moving unit 201 includes a trolley 110, a hoist 130, and a trolley/hoist driver 120. The trolley 110 is disposed to a lower portion of the boom 100. The trolley 110 is provided with a trolley wheel 111. The trolley/hoist driver 120 includes a trolley rail 121, a hoist driving motor 125, and a hoist driving cable 123.

The trolley rail 121 is fixed on the lower portion of the boom 100, and the trolley wheel 111 is guided along the trolley rail 121. A trolley horizontal-motion driver (not shown) winds a wire rope connected to the trolley 110 to provide a horizontal movement driving force to the trolley 110, so that the trolley 110 can be horizontally moved along the longitudinal direction of the boom 100 in a direction indicated by reference number D.

The hoist driving motor 125 and the hoist driving cable 123 constitutes a winding apparatus which allows the hoist 130 to wind up and down the object. That is, according to a control signal input by an operator, the hoist driving motor 125 is operated to wind the hoist driving cable 123, so that the object hooked by a hoist hook 131 of the hoist can be wound up or down.

The circumferential moving unit 300 includes circumferential moving rollers 310, 320, and 330, a circumferential moving supporter 210, and circumferential moving rail unit (301, 302). The circumferential moving supporter 210 is disposed along the circumference of the building clamp structure Bc between the boom 100 and the building clamp structure Bc. The circumferential moving rail unit (301, 302) is provided to outer side portions of the circumferential moving supporter 210. The circumferential moving rollers 310, 320, and 330 are connected to the boom 100 to move along the circumferential moving rails 301 and 302, so that the circulation movement along the circumference of the building clamp structure Bc is enabled.

The circumferential moving rollers 310, 320, and 330 include a circumferential moving roller supporter 310 and a circumferential moving driving roller 32. The circumferential moving roller supporter 310 is connected to the boom 100.

More specifically, the one end of the circumferential moving roller supporter 310 is directly attached to the boom supporting plate 101 so as to be disposed in a direction opposite to the boom 100. The circumferential moving roller supporter 310 is provided with the circumferential moving driving roller 320. The circumferential moving driving roller 320 is provided with a circumferential moving driving roller motor (not shown) to directly drive the circumferential moving driving roller and to be in contact with the circumferential moving rail 301 of the circumferential moving rail unit, so that a driving force can be provided to the boom 100, more particularly, to the circumferential moving supporter 310. According to the embodiment of the present invention, the circumferential moving roller further includes a circumferential moving guide roller 330. That is, the circumferential moving guide roller 330 is attached to the circumferential moving roller supporter 310. The circumferential moving guide roller 330 is disposed to be separated from the circumferential moving driving roller 320 so as to rotatably abut on the later-described circumferential moving rail 301. The circumferential moving guide roller 330 is a driven roller for ensuring a stable circulating movement along an outer circumference of the building clamp structure BC due to a circumferential driving force generated from the circumferential moving driving roller 320.

The circumferential moving rail unit (301, 302) includes a circumferential moving rail 301 and a circumferential moving rail support member 302. The circumferential moving rail 301 is disposed on a plane perpendicular to the building clamp structure Bc on the outer circumference of the circumferential moving supporter 210, that is, parallel to a ground. The one end of the circumferential moving rail support member 302 is fixed to the circumferential moving supporter 210, and the other end of the circumferential moving rail support member 302 is fixed on an inner side surface of the circumferential moving rail 301, so that the circumferential moving rail support member 302 enables the circumferential moving rail 301 to be disposed at a fixed position with respect to the circumferential moving supporter 210.

The self movable boom system 10 according to the present invention a plurality of the circumferential moving rollers 310, 320, and 330 and the circumferential moving rail unit (301, 302). As shown in FIG. 3, the circumferential moving rail unit (301, 302) and the circumferential moving rollers 310, 320, and 330 are disposed on the upper and lower portions of the building clamp structure Bc with longitudinal separation. In order to ensure a stable circulation movement of the boom, two columns of the circumferential moving rails of the circumferential moving rail unit are disposed along the longitudinal direction of the building clamp structure, and a plurality of the components are disposed in each column. A plurality of the circumferential moving rollers and the circumferential moving rails have the same components. Therefore, the same components are denoted by the same reference numeral. Since a plurality of the circumferential moving rails and the circumferential moving rollers are disposed, moment-originated load to the boom 100 and the object can be reduced.

Figure 4:
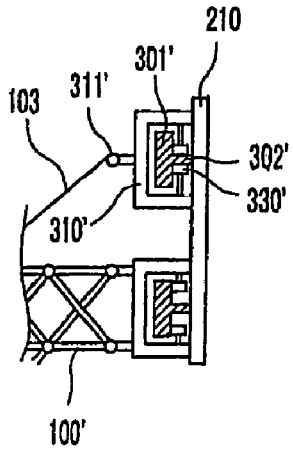
FIG. 4 is a schematic partial side view illustrating a modified example of a circumferential moving roller unit of a self movable boom system according to an embodiment of the present invention.

In some cases, a plurality of the circumferential moving rollers and the circumferential moving rails may be selectively provided. For example, as shown in FIG. 3, a pair of the circumferential moving rollers and a pair of the circumferential moving rails are disposed in upper and lower portions. The circumferential moving rollers in the upper portion may be not provided with the circumferential moving driving rollers. Alternatively, the circumferential moving guide rollers may be provided thereto. In this case, the boom supporting cable 103 may be connected to any one of a plurality of the circumferential moving rollers and the circumferential moving roller support member. That is, as shown in FIG. 4, the circumferential moving driving roller support member 310' of the circumferential moving driving roller in the upper portion is provided with the circumferential moving guide roller 330' contacting with the circumferential moving rail 301' supported by the circumferential moving rail support member 302'. The circumferential moving driving roller support member 310' can be directly connected to the boom supporting cable 103 through a support member connector 311' formed on the one end of the circumferential moving driving roller support member 310'. Due to such a structure, the boom supporting plate 101 (see FIG. 3) is excluded, so that the load can be reduced.

The lifting-up unit 400 includes a lifting-up movement driver unit 410, a lifting-up movement rail 440, and a lifting-up movement fixing unit 500. The lifting-up movement fixing unit 500 is fixed to the building clamp structure Bc. The lifting-up movement driver unit 410 can vertically lift up the boom 100, more particularly, the circumferential moving supporter 210 along the longitudinal direction of the building clamp structure Bc. The lifting-up movement fixing unit 500 includes a lifting-up fixing support member 510 and a lifting-up fixing shoe 520. The lifting-up fixing support member 510 is fixed to the building clamp structure Bc so that an end portion thereof can be exposed. The lifting-up fixing shoe 520 is fixed to the lifting-up fixing support member 510. The lifting-up movement rail 440 is detachably disposed on the lifting-up movement fixing unit 500, more particularly, the lifting-up fixing shoe 520. The one end of the lifting-up movement driver unit 410 is detachably disposed on the lifting-up movement rail 440, and the other end thereof is fixed to the circumferential moving unit 300. The lifting-up movement driver unit 410 is implemented with a hydraulic driver. The lifting-up movement driver unit 410 includes a lifting-up movement cylinder 411 and a lifting-up movement piston 413. The one end of the lifting-up movement cylinder 411 is detachably disposed through the lifting-up movement upper mounting portion 420 to the lifting-up movement rail 440. An end of the lifting-up movement piston 413 is detachably disposed through the lifting-up movement lower mounting portion 430 to the lifting-up movement rail 440. The lifting-up movement upper mounting portion 420 and the lifting-up movement lower mounting portion 430 are provided with lifting brackets used for a general auto climbing system (ACS), so that the lifting-up movement along the lifting-up movement rail 440 can be permitted and the lifting-down movement is limited. Although not shown, the lifting-up movement driver is connected through a hydraulic line (not shown) to a hydraulic controller. The lifting-up movement driver can perform extending and contracting movements according to hydraulic control signals corresponding to operation modes selected by an operator. A circumferential moving support protrusion 211 protruding toward the building clamp structure Bc is provided to one side of the circumferential moving supporter 210. The circumferential moving support protrusion 211 is connected through the circumferential moving support connector 213 to the lifting-up movement cylinder 411. Therefore, due to the extending and contracting movements by a hydraulic between the lifting-up movement cylinder 411 and the lifting-up movement piston 413 of the lifting-up movement driver unit 410, the circumferential moving supporter 210 connected to the lifting-up movement cylinder 411 is also moved so as to be lifted up with respect to the building clamp structure Bc.

Figure 5:
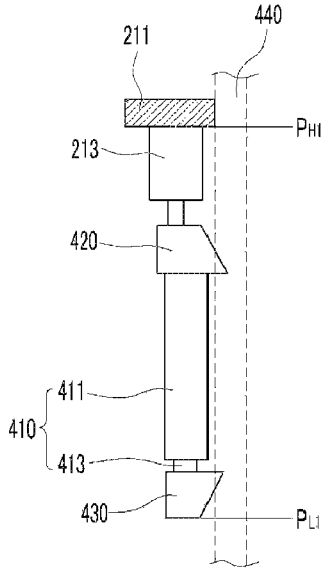
FIGS. 5 to 7 are schematic partial side views illustrating a lifting-up movement process using a lifting-up unit of a self movable boom system according to an embodiment of the present invention.
Figure 6:
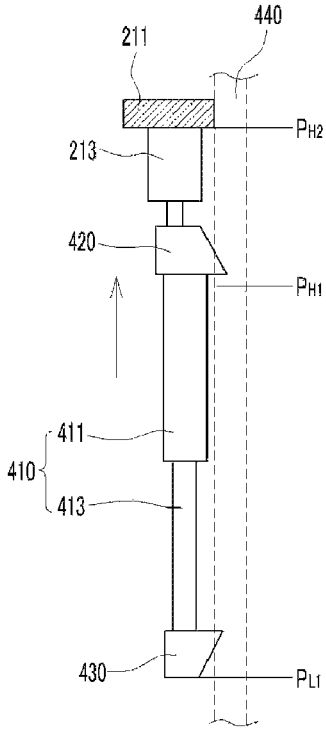
Figure 7:
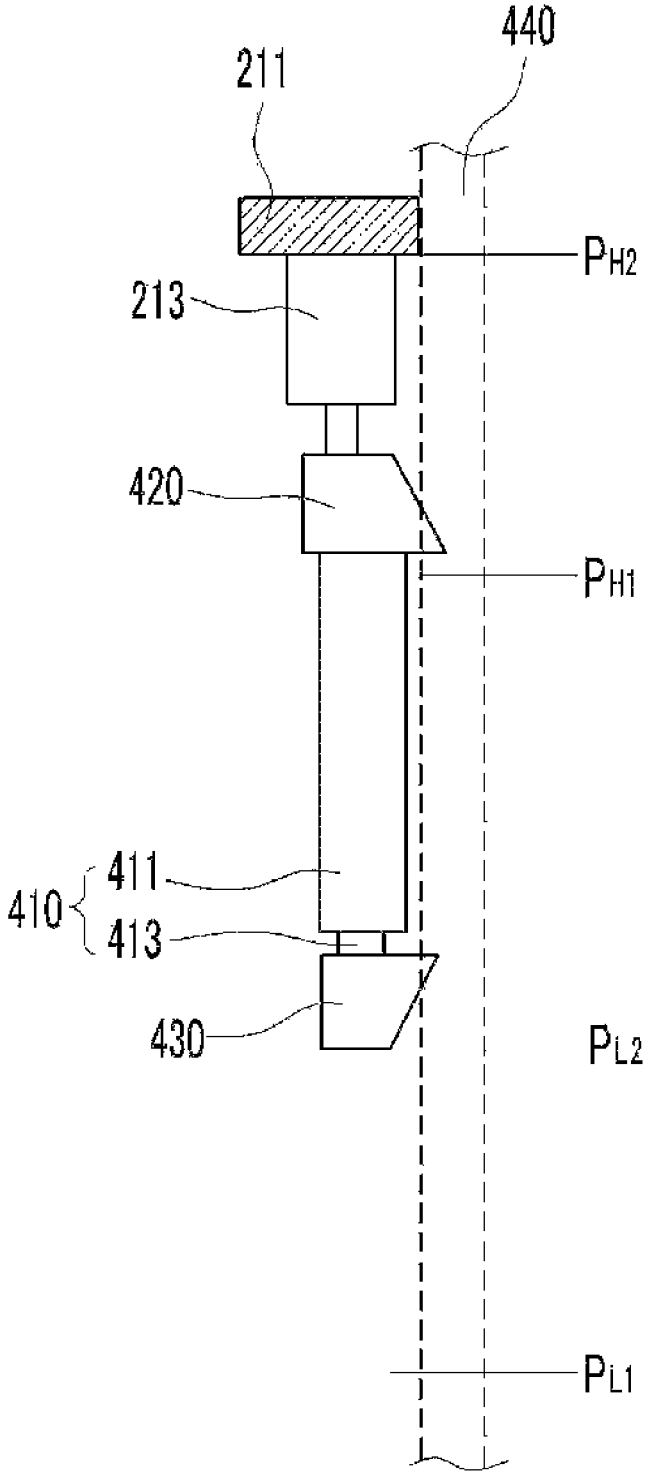

FIGS. 5 to 7 are schematic partial side views illustrating a lifting-up movement process using a lifting-up unit of a self movable boom system according to an embodiment of the present invention. FIG. 5 illustrates an initial state that the lifting-up movement piston 413 enters the lifting-up movement cylinder 411. At this time, the lifting-up movement lower mounting portion 430 is disposed at a position PL1, and the circumferential moving support connector 213 is disposed at a position PH1. Next, when the hydraulic control signal corresponding to the mode selected by the operator is applied to the lifting-up movement driver unit 410, the lifting-up movement driver unit 410 is controlled to extend. When the lifting-up movement driver unit 410 extends, a downward hydraulic pressure is exerted to the lifting-up movement lower mounting portion 430, and an upward hydraulic is exerted to the lifting-up movement upper mounting portion 420. Due to the lifting bracket structure, the lifting-up movement of the lifting-up movement lower mounting portion 430 toward the lifting-up movement rail 440 is limited, and the lifting-up movement of the lifting-up movement upper mounting portion 420 is permitted. Therefore, as shown in FIG. 6, the position of the lifting-up movement lower mounting portion 430 is maintained at the position PL1, and the position of the circumferential moving support connector 213 is changed to the position PH2.

Next, when a hydraulic control signal corresponding to a contraction mode is applied to the lifting-up movement driver unit 410, the lifting-up movement piston 413 enters the lifting-up movement cylinder 411. At this time, the lifting-down movement of the lifting-up movement upper mounting portion 420 is limited. Therefore, the position of the lifting-up movement upper mounting portion 420 is maintained at the position PH2, and the position of the lifting-up movement lower mounting portion 430 is lifted up to the position PL2. In this manner, due to repetitive extending and contracting movements of the lifting-up movement driver unit 410, the circumferential moving supporter 210 connected to the lifting-up movement driver unit 410 can lift up along the building clamp structure Bc.

In a case where the lifting-up movement driver unit 410 is not moved and the circumferential moving supporter 210 is disposed at a fixed position with respect to the building clamp structure Bc, the circumferential moving supporter 210 may be disposed at a fixed position through one or more lifting-up unit fixing spindles 220 with respect to the lifting-up movement rail 440.

The aforementioned embodiments are provided exemplarily, and thus, the present invention is not limited thereto. In the aforementioned embodiment, the circumferential moving roller is directly provided with the circumferential moving driving roller. However, wires are connected to both ends of the circumferential moving support member, a circulation motor winding up the wires may be provided to the circumferential moving rail or the building clamp structures so as to perform the circulation movement by using the wires. Therefore, the self movable boom system according to the present invention can be implemented in various medications within the scope of the construction including a boom moving unit for performing a horizontal movement, a winding-up movement, and a winding-down movement of an object along the boom, a circumferential moving unit for performing a circulation movement to move the boom along an outer circumference of the building clamp structure, and a lifting-up unit for performing a lifting-up movement to lift up the boom along the longitudinal direction of the building clamp structure.

According to a self movable boom system of the present invention, the following advantages can be obtained.

Firstly, in the self movable boom system according to the present invention, a suitable height between working area and a boom can be ensured, so that it is possible to solve difficulty in tasks due to positional error caused from shaking at the time of moving an object.

Secondly, the self movable boom system according to the present invention has a structure capable of performing a circulation movement along an outer circumference of the building clamp structure, so that it is possible to maintain a suitable height of the boom and to ensure a larger work working area.

Thirdly, the self movable boom system according to the present invention has a self lighting-up movement structure using the lifting-up unit, so that it is possible to obtain a stable lifting-up movement.

Fourthly, the self movable boom system according to the present invention can be implemented with a simple, light-weighted structure, so that it is possible to reduce production and installation costs and time and process cost. In addition, due to the simple structure, it is possible to easily implement automation of construction processes.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A self movable boom system, comprising:

a boom disposed on a building clamp structure and extending horizontally and in a direction perpendicular to the building clamp structure; and a moving unit apparatus, including:

a circumferential moving unit disposed between the boom and the building clamp structure to move the boom in a circumferential direction around the building clamp structure, a lifting-up unit having one end disposed toward the circumferential moving unit and another end disposed toward the building clamp structure to move the boom vertically and in a longitudinal direction of the building clamp structure, and a boom moving unit which moves an object both vertically and along the longitudinal direction of the building clamp structure, and horizontally and along a longitudinal direction of the boom.

2. The self movable boom system according to claim 1, wherein the boom moving unit comprises:

a hoist movably connected to the boom to move the object;

a trolley connected to the boom to move along the longitudinal direction of the boom; and a hoist driver connected to the trolley to move the trolley in a direction parallel to the longitudinal direction of the boom.

3. The self movable boom system according to claim 2, wherein the circumferential moving unit comprises:

a circumferential moving roller unit including a circumferential moving roller supporter connected to the boom and a circumferential moving driving roller unit connected to and driving the circumferential moving roller supporter;

a circumferential moving supporter disposed between the building clamp structure and the boom along an outer circumference of the building clamp structure; and a circumferential moving rail unit including a circumferential moving rail disposed on an outer circumference of the circumferential moving supporter to contact with the circumferential moving roller unit and a circumferential moving rail support member, the circumferential moving rail support member having one end connected to the circumferential moving rail and another end connected to the circumferential moving supporter.

4. The self movable boom system according to claim 3, comprising a plurality of the circumferential moving roller units and a plurality of the circumferential moving rail units divided into groups, each of the groups being separated from each other in a direction parallel to the vertical longitudinal direction of the building clamp structure.

5. The self movable boom system according to claim 3, further comprising a boom supporting cable having one end connected to the boom and another end connected to the circumferential moving unit.

6. The self movable boom system according to claim 5, wherein the other end of the boom supporting cable is connected to any one of the plurality of the circumferential moving roller units.

7. The self movable boom system according to claim 3, wherein the circumferential moving roller unit comprises one or more circumferential moving guide roller units separated from the circumferential moving driving roller unit and rotatably in contact with the circumferential moving rail.

8. The self movable boom system according to claim 1, wherein the lifting-up unit comprises:

a lifting-up movement fixing unit including a lifting-up fixing support member fixed to the building clamp structure and a lifting-up fixing shoe connected to the lifting-up fixing support member; and a lifting-up movement driver unit including a lifting-up movement rail detachably connected to the lifting-up movement fixing unit and a lifting-up movement driver having one end detachably connected to the lifting-up movement rail and another end fixed to the circumferential moving unit to perform extending and contracting movements.

* * * * *